US005628475A

United States Patent [19]

Warnaar

[11] Patent Number: 5,628,475

[45] Date of Patent: May 13, 1997

[54] CLAMPING ARRANGEMENT FOR HOLLOW OBJECTS WITH AN END FACE

[76] Inventor: Dirk B. Warnaar, 115 Windswept La., Cary, N.C. 27511

[21] Appl. No.: 593,168

[22] Filed: Feb. 1, 1996

[51] Int. Cl.[6] ..... B65H 75/24

[52] U.S. Cl. ..... 242/571.4; 279/2.24

[58] Field of Search ..... 242/571.3, 571.4, 242/571.5, 596.7, 597.2, 597.3, 599.2, 46.2; 279/2.24, 2.15, 2.16, 2.04; 269/48.1; 82/169

[56] References Cited

U.S. PATENT DOCUMENTS

| | | | |
|---|---|---|---|
| 2,369,093 | 2/1945 | Washam | 242/571.3 |
| 3,704,837 | 12/1972 | Heinz et al. . | |
| 4,291,844 | 9/1981 | Blickley et al. | 242/571.4 |
| 4,715,553 | 12/1987 | Hatakeyama et al. . | |
| 4,773,656 | 9/1988 | Chlupsa . | |
| 4,795,106 | 1/1989 | Weiss et al. . | |

*Primary Examiner*—John M. Jillions

[57] ABSTRACT

The present invention relates to a clamping arrangement for hollow objects, whereby the clamping arrangement is equipped with one or more clamping bodies distributed circumferentially to facilitate the transfer of a lateral force and/or torque applied to the clamping arrangement to a hollow object or vice versa. The clamping arrangement for one or each end of a hollow object comprises of a center body capable of lifting and centering a hollow object; one or more clamping bodies distributed circumferentially and capable of sliding and rotating with respect to the center body in response to contact with the end face of a hollow object while a longitudinal force is applied to the center body or hollow object, and arranged so as to maintain the center position of the center body inside the hollow object during the clamping motion; and a containment ring elastically extendible or elastically and radially expandable, and arranged so as to restore the retracted position of the clamping bodies when the lateral force applied to the center body is removed.

14 Claims, 6 Drawing Sheets

CLAMPING ARRANGEMENT FOR HOLLOW OBJECTS WITH AN END FACE

BACKGROUND OF THE INVENTION

The present invention relates to a clamping arrangement for hollow objects and, more particularly, hollow cores for winding newsprint and the like. Newsprint rolls and the like are wound on hollow cores, and are characterized by large mass and inertia. For example, rolls of newsprint may be approximately 1.40 meter long with a diameter of approximately 1.00 meter and have a mass in excess of 1,000 kg. During winding and unwinding operations of newsprint rolls and the like, and particularly when these operations are abruptly halted during emergency situations, large forces and torques are applied to the hollow cores with small inside diameters, typically on the order of 7.5 centimeter.

Various types of clamping arrangements for hollow cores are known. However these known arrangements have shortcomings relating to time consuming procedures for preparing the hollow core for the clamping action, the incompatibility with robotic handling procedures, the poor load transfer between the hollow object and the clamping arrangement, the damage inflicted on the hollow core, the inability to adjust to the core inside diameter, the inability to release the hollow core upon removal of the clamping force, and to the complexity and inherent production cost of the clamping arrangement.

Shafts are known which can be slid, usually in a fairly complicated manner, through the hollow cores and which are combined with elements which can spread out from the shaft to hold the core on the shaft. Such shafts require operation by at least two persons when handling heavy rolls. Due to the high labor cost associated with this time consuming procedure, shafts of this type are no longer considered for high production printing facilities.

Increased production demands on printing facilities have led to the development of mobile robots that retrieve a newsprint roll from a storage facility and load this roll on the printing press. Current robotic systems are incompatible with clamping arrangements that are based on a preferred orientation of the newsprint roll, such as arrangements that use a keyway in the hollow core, and with clamping arrangements that are incapable of releasing the empty core that remains after unwinding of the web material to prepare the printing press for loading of another roll, such as arrangements that depend on metal caps on hollow cores for the transmission of torque from the clamping arrangement to the hollow core.

Clamping arrangements are known which employ a cone tapering from a diameter slightly larger than the hollow core's inner diameter to a diameter slightly smaller than the hollow core's inner diameter. In this arrangement the V-shaped grooves placed on the circumference of the cone facilitate the torque transfer from the clamping arrangement to the hollow core and vice versa. These cones have the tendency to damage the ends of the cores and therefore do not provide for reliable transfer of high torque loads to the cores. Furthermore, (during continued rotational acceleration and deceleration of the hollow core the damage inflicted on the hollow core increases which leads to a further degradation of the ability of the clamping arrangement to transfer high torque loads. In some cases, hollow cores are equipped with metal end-caps to overcome the poor load transfer between the clamping arrangement and the hollow core. However, use of the metal end-caps causes excessive wear to the clamping arrangement during normal operation and in practice it is difficult to ensure a reliable load transfer between the metal cap and the hollow core. Frequently metal caps make insufficient contact with the hollow core and occasionally cause combustion of the web type material induced by the rapid spinning of the metal cap with respect to the hollow core. Use of the metal end-caps has the added disadvantages that they increase the cost of newsprint and that they prohibit recycling of the core and the newsprint that remain at the completion of the unwinding operation.

Clamping arrangements are known comprising of a plurality of jaws which can spread by being swingably mounted on pivots, or by moving the jaws along conical or cylindrical surfaces in axial direction. Known clamping arrangements in these categories incorporate a large number of parts and are characterized by large rotations or translations of the jaws during the clamping motion, which are therefore prone to considerable wear during normal operations. Due to these shortcomings, known clamping arrangements in these categories are expensive to produce and have high maintenance costs. Jaws swingably mounted on pivots have the added disadvantage that the clamping force is transferred through the pivots which are ill suited for this purpose, and that, to facilitate the pivots, the integrity of the jaws themselves must be compromised. Clamping arrangements involving jaws that are moved along conical surfaces in axial direction have the added disadvantage that these clamping arrangements are longer than their counterparts and often cannot be placed in the limited space available between the hollow core and the mount for the clamping arrangement. Clamping arrangements involving jaws that are moved along cylindrical surfaces in the axial direction have the added disadvantage that they are incapable of clamping hollow objects of larger dimension than the center portion of the clamping arrangement and that the clamping pressure exerted by the clamping arrangements on hollow objects cannot be adjusted.

Dual acting clamping arrangements are known in which the longitudinal and radial clamping of the hollow core is achieved through two or more separately controlled mechanisms incorporated in a single clamping arrangement. Although dual acting clamping arrangements offer superior clamping performance, they dramatically increase the cost of peripheral equipment that accommodate separate control of the two mechanisms incorporated in the clamping arrangement. In most newsprint winding and unwinding facilities only the longitudinal movement of the clamping arrangement can be controlled, making the use of dual acting clamping arrangements infeasible.

SUMMARY OF THE INVENTION

It is therefore the object of the present invention to provide an easy to fabricate, easy to assemble, easy to operate, low cost and low maintenance clamping arrangement of the initially mentioned category which can center and hold one end of a hollow object of large mass and inertia, which can adjust to hollow objects with different inside dimensions, which can absorb high support forces and torques without slip, which does not damage the inside perimeter of a hollow object, which releases said hollow object upon removal of the clamping force, and which has a long operational life. This problem is solved through the features of the present invention.

In the preferred embodiment of the present invention the clamping arrangement consists of a center body, at least one clamping body, and a containment ring. The center body is capable of engaging and positioning a hollow object prior to the clamping action by having a sleeve-shaped portion being disposed between the first and second ends of the center body, wherein the first end has a taper, and the second end has a collar. The sleeve-shaped and tapered portions of the center body accommodate at least one longitudinally extending slot and the collar accommodates at least one radially extending slot, wherein each radially extending slot is coordinated with one longitudinally extending slot to accommodate a clamping body having a first jaw in a respective longitudinally extending slot of the sleeve-shaped portion, and a second jaw in a respective radially extending slot of the collar. The sleeve-shaped portion of the center body has a groove, whereby said groove is coordinated with a groove in each clamping body of the clamping arrangement to accommodate a containment ring. An optional collar, located at the root of the center body, provides maximum contact resulting in optimum load transfer between the second jaw and the center body, and prevents the hollow object from sliding over the center body in the absence of the clamping bodies.

The present invention is capable of clamping hollow objects by employing one or more clamping bodies which sit snugly in slots in the center body. In the absence of a hollow object, a longitudinally extending first jaw of the clamping body rests in the center body while its second jaw protrudes endwise out of the collar. As the clamping arrangement is slipped into a hollow object, the end face of the hollow object runs against the second jaw and simultaneously swings and slides the clamping body around, causing the first jaw to jut out of the sleeve part of the center body and grip the inside circumference of the hollow object. As the end face of the hollow object runs on the second jaw of the clamping body, a line contact occurs first, which in the further course of the clamping motion transforms into an a real contact due to the swing motion of the clamping body and causes the second jaw to grip the end face of the hollow object. The clamping arrangement is completely safe in operation because a closed or open ring or spring placed peripherally into the center body serves to restore the clamping bodies in their home position and subsequently prevents unassisted separation of the individual parts of the clamping arrangement.

Each clamping body in the present invention accommodates clamping of hollow objects of larger dimension than the sleeve-shaped portion of the center body. In the inoperative condition of the clamping arrangement, the bottom face of the first jaw of the clamping body is in full contact with the bottom surface of the horizontally extending slot in the center body and the back face of the second jaw of the clamping body makes contact with the back surface of the radially extending slot at the boundary of the back face of the second jaw and a curved inner surface disposed between the first jaw and the second jaw. The run-on action of the end face of a hollow object with the second jaw initiates a swinging motion of the clamping body whereby the contact area between the first jaw and the bottom surface of the horizontally extending slot in the center body reduces to a line contact adjacent to the boundary between the bottom face of the first jaw and a curved outer surface disposed between the bottom face of the first jaw and the back face of the second jaw. Facilitated by an inclination of the end face of the first jaw, the clamping body continues the swinging motion by sliding the line contact adjacent to the boundary between the bottom face of the first jaw and said curved outer surface along the bottom of the horizontally extending slot, and sliding the line contact adjacent to the boundary between the back face of the first jaw and said curved outer surface along the back surface of the radially extending slot. The swinging motion causes the center of gravity of the clamping body to move horizontally and radially, and the first jaw of the clamping body to move beyond the peripheral contact surface of the sleeve-shaped portion of the center body.

The present invention maximizes the hold on a hollow object and the ability to adjust to hollow objects of different inside dimensions by placing the center of rotation of a clamping body as far as possible from the contact surfaces of the clamping body and by optimizing the angle of inclination of the contact face of the second jaw. In the present invention, the center of rotation of a clamping body is located at the center of curvature of the curved outer surface disposed between the bottom face of the first jaw and the back face of the second jaw of the clamping body. If the clamping body were swingably mounted on a pin through the clamping body, then the pin, and therefore the center of rotation of the clamping body, must be located closer to the contact surfaces of the clamping body. The hold and adjustment capability of the clamping arrangement is also determined by the angle of inclination of the contact face of the second jaw. As a result of the run-on action of the end face of a hollow object with the second jaw, the clamping body will continue to rotate until the forces acting on the contact faces of the first and second jaw and at the line contacts between the clamping body and the center body are in equilibrium. The angle of inclination of the contact face of the second jaw affects the distribution of the contact forces on the first and second jaw of the clamping body. By selecting an appropriate angle of inclination, an optimal distribution of the contact forces can be achieved.

A containment ring prevents unassisted separation of the clamping body and the center body and restores the inoperative condition of the clamping body upon removal of a force sustaining the clamping action. The containment ring is placed in the groove of each clamping body and a groove in the center body, whereby said grooves are coordinated to accommodate a single containment ring and to force the containment ring to radially extend or expand by the swinging motion of the clamping body. The containment ring is elastically and radially extendible or expandable to accommodate assembly of the clamping arrangement, whereby said ring is placed in the grooves of the clamping body and center body. In the inoperative condition the containment ring is sufficiently elastically and radially extended or expanded to force the bottom face of the first jaw of the clamping body to make full contact with the bottom of the horizontally extending slot in the center body. Upon removal of the force acting on the second jaw of the clamping by forced contact of a hollow object with said second jaw, the containment ring is sufficiently elastically and radially extended or expanded to release the hollow object and to restore the clamping body to the inoperative condition.

The present invention is capable of transmitting a torque to hollow objects of a hard or soft material. Transmission of a torque from a center body to a clamping body is facilitated through contact forces at the sides of the longitudinally slots in the center body. Transmission of a torque from a clamping body to a hollow object of a hard or soft material is facilitated through friction forces at the surfaces of a clamping body that are in contact with a hollow object. The friction forces at the surfaces of a clamping body are sustained by the longitudinal force applied to the center body. In this sense, the hold of the clamping arrangement can be regulated by controlling the longitudinal force applied to the center body. Use of the present invention on hollow objects of a soft material can result in a deformation of their end face and inside circumference, and consequently result in a deep digging of the first and second clamping body jaw into the hollow object, thus further increasing the hold of the clamping arrangement on the hollow object.

In the present invention, the clamping body provides optimal force transmission and optimal grip through long rectangular contact surfaces on hollow objects of a hard material, and through a maximum contact area caused by deep penetration in hollow objects of a soft material without damaging the material of hollow objects. The first jaw of a clamping body is provided with toothing extending parallel to the side that makes contact with the inside circumference of the hollow object, and with toothing extending parallel to the side that makes contact with the end face of the hollow object, to achieve an especially intensive form fit to safeguard against a turning of the hollow object with respect to the clamping arrangement. This is accomplished in a simple manner in that each individual toothing of the clamping body has the geometrical feature of two quarter circular profiles of which the centers are placed further apart than the radii of these two profiles combined. The distances between the centers of the circular profiles determine the pressure per unit area exerted by a clamping body on a hollow object and can therefore be optimized for specific applications of the clamping arrangement.

The present invention has a long operational life. During rotation of the clamping body, the line contacts of the clamping body with the center body remain stationary with respect to the center body and only move a minimal amount with respect to the clamping body (on the order of 1 mm for newsprint applications). As a result, component wear is orders of magnitude less than for other known clamping arrangements. Furthermore, wear of the clamping arrangement has a minimal effect on the motion of the clamping body during the clamping action and therefore does not prevent the clamping arrangement from holding on to a hollow object. The hold of the clamping arrangement can be regulated by changing the longitudinal force applied to the center body, or by changing the height of the first jaw of the clamping body. Hence, any degradation in the hold of a clamping arrangement can be offset by increasing the longitudinal force applied to the center body, or by placing one or more strips of material between the bottom face of the first jaw of a clamping body and the bottom face of a longitudinally extending slot.

In alternative embodiments of the present invention, the cross-section of the center body can be altered and the tapered portion of the center body can be replaced by an otherwise cross-sectional reducing portion that forms a transition between the sleeve-shaped portion of the center body and the end face of the center body that first engages with the hollow object. The cross-sections of portions of the center body are not required to have cylindrical features to achieve successful clamping action, but can have other geometrical features to accommodate a specific category of hollow objects provided that one or more clamping body can be accommodated. The center body is also not required to have a tapered or otherwise cross-sectional reducing portion to achieve successful clamping action, but said portion increases the allowable margin of error in aligning the longitudinal axis of the clamping arrangement with the longitudinal axis of the hollow object, thereby simplifying the positioning of the clamping arrangement prior to the clamping action.

In other alternative embodiments of the present invention, the clamping arrangement can be comprised of individual pieces whereby the combination form the center body, one or more clamping bodies and the containment ring. In the preferred embodiment of the present invention the number of individual components is small. In some cases it can be advantageous to increase the number of components, particularly if compatibility of the clamping arrangement with different mounts or spindles is desired.

The geometric features of the containment ring and the accommodating grooves in the center body and clamping body of the preferred embodiment of the present invention can be altered without affecting the motion of each clamping body during the clamping action. The center body and each clamping body are not required to have a groove to accommodate the containment ring, but the addition of said grooves eliminates the interference of the containment ring with the hollow core during the clamping action and avoids the wear of the clamping arrangement. The containment ring in the preferred embodiment of the present invention can be replaced by elastically extending or radially expanding components placed at or in the vicinity of a clamping body, but these alternatives do not offer the simplicity of fabrication and assembly offered by the preferred embodiment of the present invention. Elimination of the containment ring by allowing the clamping body to rotate about a pin inserted in the center body is an unacceptable option since said pin reduces the load carrying capability of the clamping body and places the center of rotation of the clamping body in this configuration closer to the center of gravity of the clamping body than in the preferred embodiment of the present invention, thus reducing the amount the clamping body can move beyond the sleeve-shaped part of the center body.

The present invention has the following advantages. Since the clamping bodies extend longitudinally and radially and thus maximize the area of contact both with the inside perimeter as well as the outside rim of the hollow object, the clamping arrangement is able to support large loads. The transmission of longitudinal forces at the area of contact between the clamping bodies and the outside rim of the hollow object and at initial engagement of the clamping arrangement with the hollow object causes the clamping bodies to slide and rotate, and move beyond the peripheral contact surface of the sleeve-shaped portion of the center body so as to maximize the area of contact with the hollow object and enable clamping of hollow objects of larger inside dimension than the sleeve-shaped portion of the center body. The clamping arrangement enables the non-slip transmission of high torques since the longitudinal force applied to the clamping arrangement is leveraged to a radial pressure which is uniformly applied to the hollow object, and since the rotating and sliding clamping bodies engaging the hollow object are arranged in the sleeves of the center body in a form fitting fashion. As the lateral force applied to the center body is removed, the expanded or extended containment ring returns to the undisturbed condition and restores the clamping bodies to their retracted position which in turn causes the hold on the hollow object to be removed and the hollow object to be released. The clamping arrangement comprises of few components and does not require large movements nor elastic deformation of said components prior to, during, or after the clamping action. During the clamping action there is minimal sliding of the clamping body with respect to the center body, so that the clamping arrangement does not require lubrication and there is no measurable wear of individual components. Further advantages are that the clamping arrangement is simple to operate, is suitable for robotic handling procedures, does not damage the hollow object, requires little if no maintenance, features components that are simple to manufacture, is comprised of few components, and can be easily assembled and disassembled.

DESCRIPTION OF THE PREFERRED EMBODIMENTS

Figure 1:
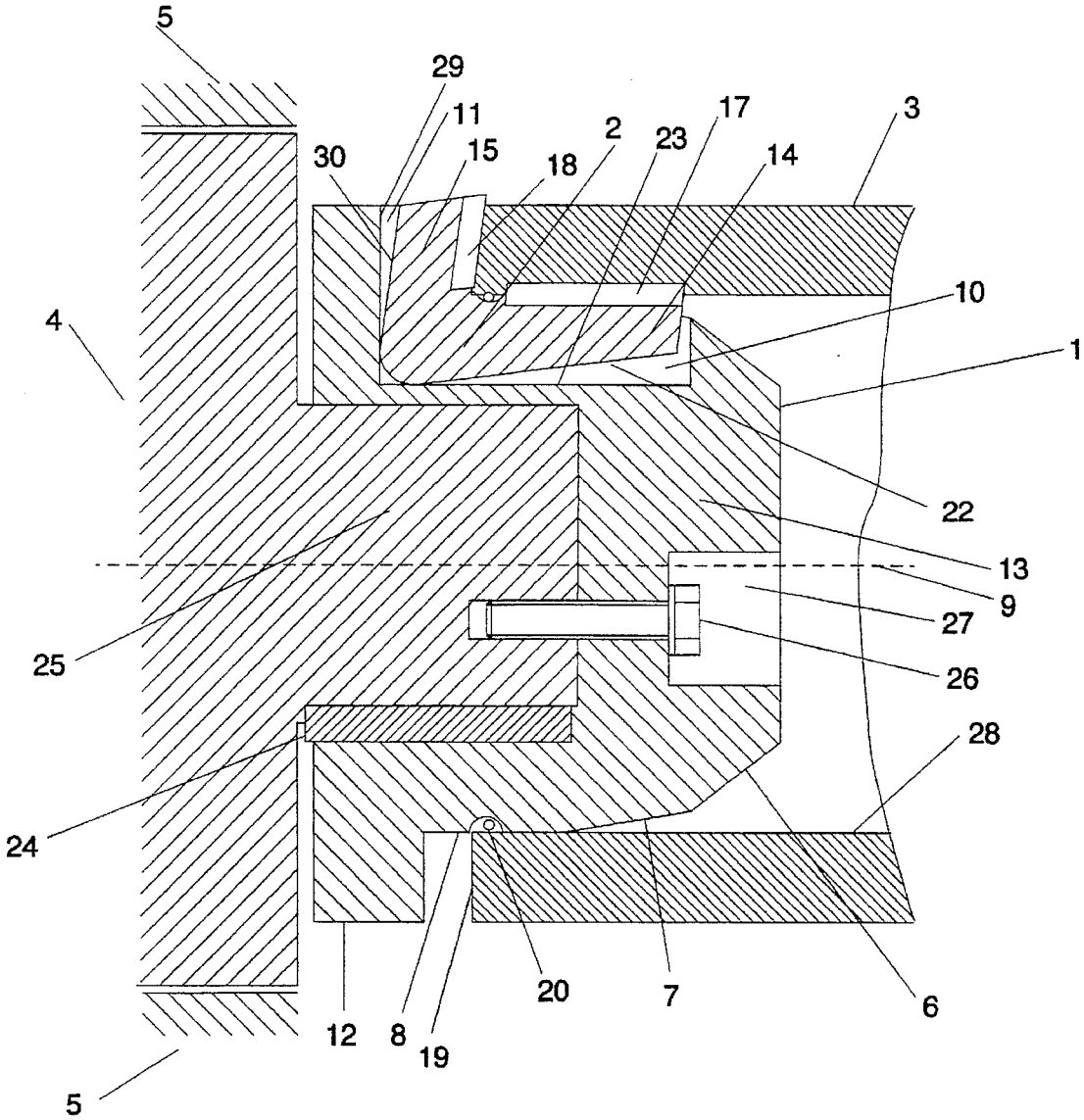
FIG. 1 is a side elevation view of an embodiment of the clamping arrangement according to the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
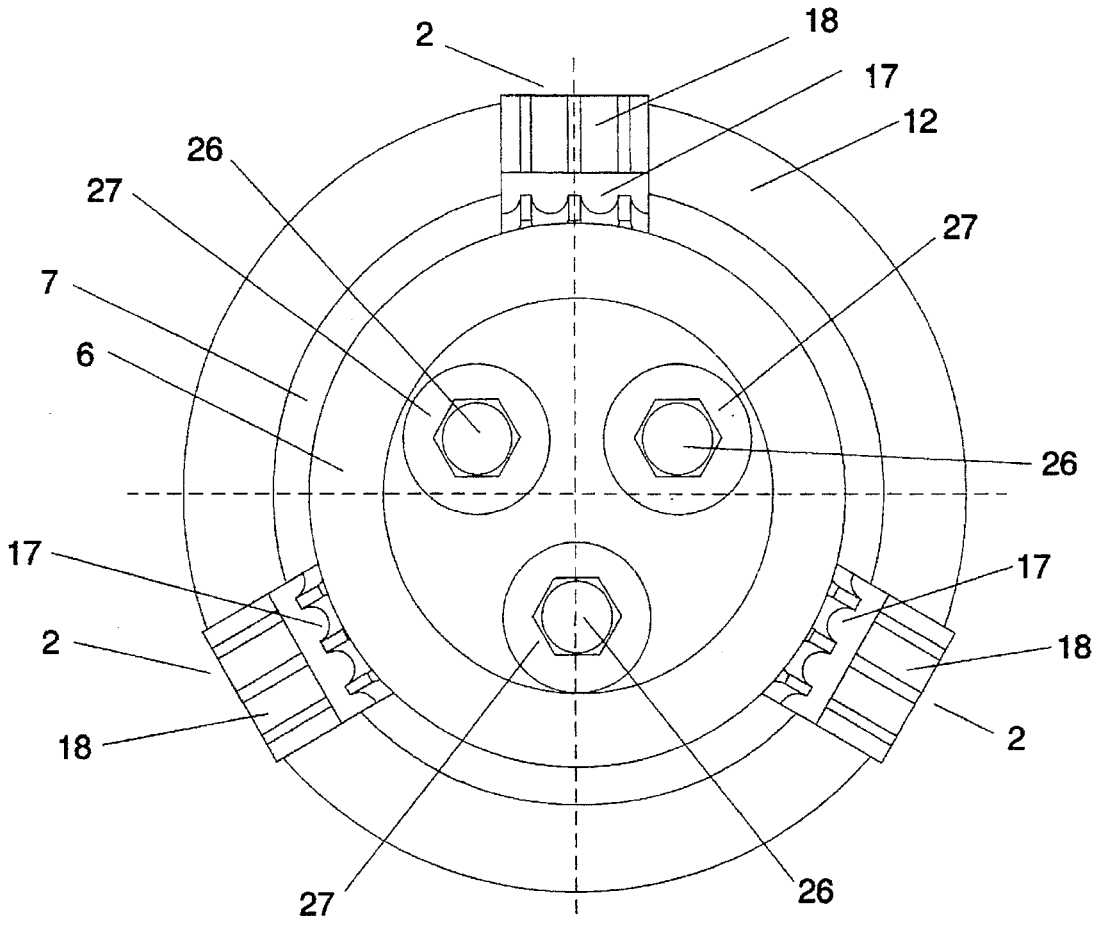
FIG. 2 is a front elevation view of the clamping arrangement.

With reference to the drawings, a clamping arrangement embodying the teachings of the subject invention is generally designated as 1. In FIG. 1, the clamping arrangement 1 engages with the clamping bodies 2 a hollow object 3. One clamping arrangement 1 is situated at one end of the hollow object 3, and an optional second clamping arrangement 1, with or without the clamping bodies 2, is situated at the other end of the hollow object 3, thereby guiding the hollow object 3 during spinning operations, such as winding or unwinding of web type material. One or both clamping arrangements 1 are mounted on a spindle 4 and inserted into the hollow object 3 by extending one of the spindles 4 in longitudinal movable fashion through a spindle guide 5. During this operation, the primary taper 6, secondary taper 7, and the sleeve-shaped part 8 of the clamping arrangement 1 provide the centering and the axial alignment of the hollow object 3. Additionally, the clamping arrangement 1 is equipped with one or more clamping bodies 2 which are uniformly distributed, as depicted in FIG. 2, around the circumference of the sleeve-shaped part 8 and engage the hollow object 3 so as to secure the hollow object 3 and to transmit in the case of a rotationally driven or retarded clamping arrangement a torque to the hollow object 3. The mode of operation of the clamping bodies 2 will be described hereafter with the aid of FIGS. 1, 2 and 3.

Figure 3:
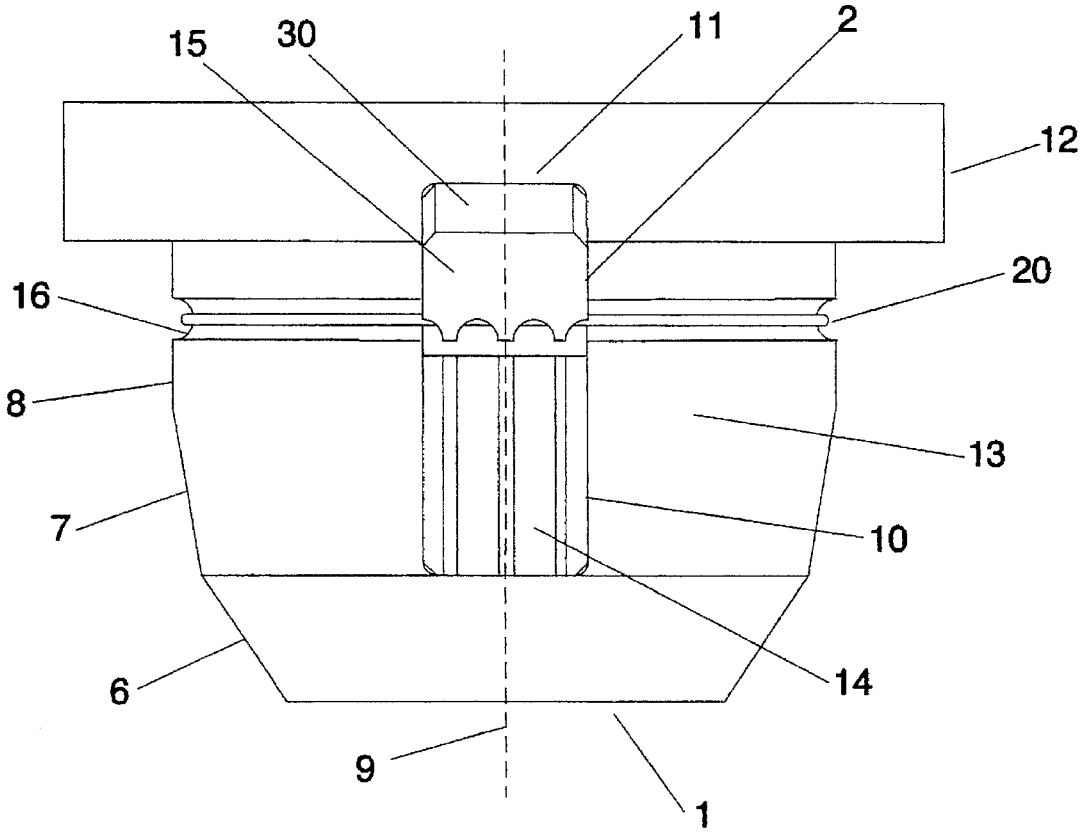
FIG. 3 is a top elevation view of the clamping arrangement.
Figure 4:
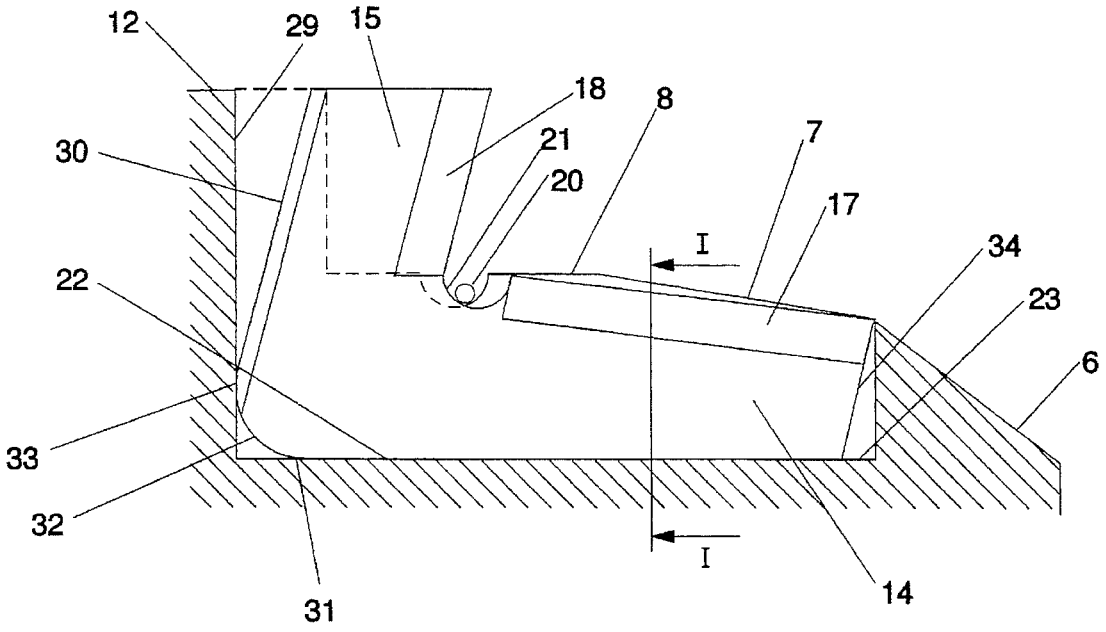
FIG. 4, is an enlarged view of a section of the clamping arrangement of FIG. 1 with a clamping body in home position.
Figure 5:
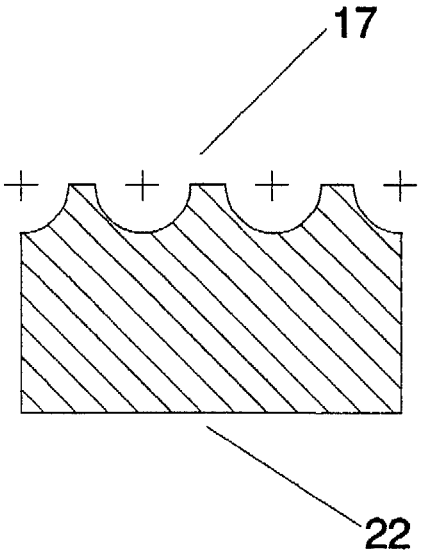
FIG. 5 is an enlarged view of a section of the clamping body along line I—I in FIG. 4.

Forming a unit together with the collar 12 extending perpendicularly to the center body axis 9, the sleeve shaped part 8 is provided with longitudinally extending slots 10 (one for each clamping body 2) and radially extending slots 11 (one for each clamping body 2) which are distributed around the circumference of the center body 13 (FIG. 3). Slots 10 originate from the collar 12 and end at the same longitudinal station as the secondary taper, away from the collar 12. The center body 13 is at one end provided with two tapered surfaces 6 and 7 so as to facilitate the insertion of the clamping arrangement 1 into the hollow object 3. Coordinated with each slot pair 10 and 11 is one clamping body 2, each featuring two jaws 14 and 15. The first jaw 14 sits snugly in the slot 10 in the sleeve-shaped part 8 and the secondary taper 7 while the second jaw 15 is directed radially outward and sits snugly in the slot 11 in the collar 12. The first jaw 14 of the clamping body 2 has in the area of its root a cross-sectional reduction caused by a groove 16 in the center body 13. Originating from this cross-sectional reduction, a longitudinally extending toothing 17, depicted in FIGS. 4 and 5, is provided on the side of the first jaw 14 which makes contact with the inside circumference of the hollow object 3 in the operational position of the clamping body 2. Additionally, the second jaw 15 originating from the cross-sectional reduction features a toothing 18 parallel to its inclined face which makes contact with the end face 19 of the hollow object in the operational position of the clamping body 2, and which has cross-sectional properties similar to the first jaw 14.

Referring to FIG. 1, the clamping arrangement is assembled by inserting the clamping bodies 2 into the slots 10 and 11 of the center body 13 and sliding a containment ring 20 over the primary taper 6, secondary taper 7 and sleeve shaped part 8 until it rests in the groove 16 of the center body 13 and, as depicted in FIG. 4, in the grooves 21 of the first jaws 14 of the clamping bodies 2. In this configuration the containment ring forces the bottom faces 22 of the clamping bodies 2 to rest on the bottom surfaces 23 of the horizontal slots 10, preventing the clamping bodies 2 in the inoperative position from moving out of the slots 10 and 11 of the center body 13.

Referring again to FIG. 1, the clamping arrangement 1 is mated with the spindle 4 by aligning its keyway 24 with the spindle extrusion 25 and securing this configuration with one or more bolts 26 which are recessed in the cavities 27. In this configuration the keyway 24 provides a means of transmission of torque between the clamping arrangement 1 and the spindle 4, and the bolts 26 provide a means of transmission of longitudinal forces acting on the clamping arrangement 1 away from the spindle 4. Alternatively, in the absence of a keyway, the bolts 26 also provide a means of transmission of torque between the clamping arrangement 1 and the spindle 4.

Figure 6:
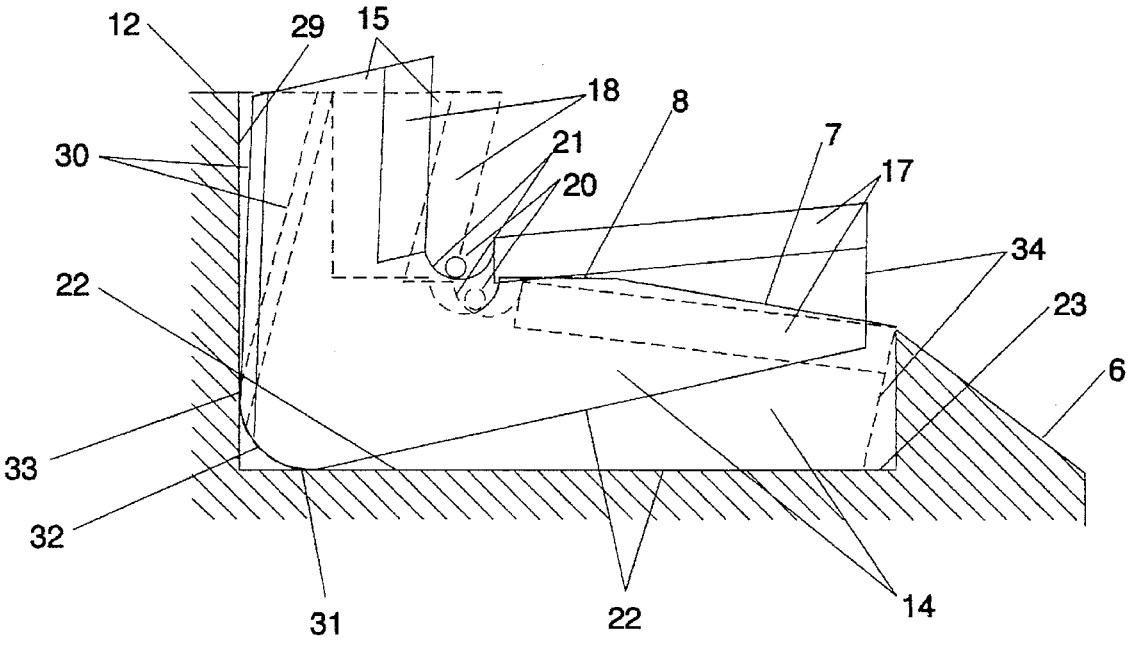
FIG. 6 is an enlarged view of a section of the clamping arrangement of FIG. 1 with a clamping body in home position, and with a clamping body engaging in the hollow object.

Referring to FIGS. 1 and 6, as the clamping arrangement 1 is inserted in the hollow object 3, the hollow object 3 slides with its inside circumference 28 over first the primary taper 6, then the secondary taper 7, and subsequently the sleeve shaped part 8 of the center body 13 so as to lift the hollow object 3 and center it on the clamping arrangement 1. When running onto the toothing 18 of the second jaws 15 of the clamping bodies 2, the end faces 19 of the hollow object causes the contact area between the first jaws 14 and the bottom surfaces 23 of the horizontally extending slots 10 in the center body 13 to reduce to the boundaries 31 between the bottom face 22 of the first jaws 14 and curved outer surfaces 32 disposed between the bottom faces 22 of the first jaws 14 and the back faces 30 of the second jaws 15. In the process, the clamping bodies 2 rotate facilitated by the inclined end faces 34 of the first jaws 14 and by sliding the boundaries 31 along the bottom surfaces 23 of the horizontally extending slots 10, and simultaneously sliding the boundaries 33 between the back faces 30 of the first jaws 15 and the curved outer surfaces 32 along the back surfaces 29 of the radially extending slots 11. Moved out beyond the peripheral surface of the sleeve shaped part 8 and the secondary taper 7, the toothings 17 on the first jaws 14 engage with the inside circumference 28 of the hollow object 3. This motion is completed when the forces imposed by the end face 19 of the hollow object 3 on the second jaws 15 and the radial forces, opposing further digging of the toothings 17 of the first jaws 14 into the inside circumference 28 of the hollow object 3, reach an equilibrium, or when the back faces 30 of the second jaws 15 make full contact with the back surfaces 29 of the vertical slots 11 and maximum rotation of the clamping bodies 2 is reached (FIG. 1).

Referring again to FIG. 1, as the clamping arrangement 1 is retracted from the hollow object 3, the forces imposed by the end face 19 of the hollow object 3 on the second jaws 15 are eliminated and the containment ring 20 forces the clamping bodies 2 to rotate until the bottom faces 22 of the first jaws 14 rest on the bottom surfaces 23 of the horizontal slots 10. In this situation the first jaws 14 of the clamping bodies 2 have retracted completely into the horizontal slots 10 of the center body 13.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A clamping arrangement for a hollow object, the hollow object having an end face and an inner circumference accommodating said clamping arrangement, the clamping arrangement comprising:

a center body, including:

a) a first end having a taper;

b) a second end having a collar, wherein the collar has at least one radially extending slot; and c) a sleeve-shaped portion disposed between the first and second ends and having a peripheral contact surface for engaging and centering the hollow object, the sleeve-shaped portion having at least one longitudinally extending slot, wherein each of the at least one longitudinally extending slot corresponds to each of the at least one radially extending slot; and at least one clamping body, wherein the at least one clamping body corresponds to the at least one longitudinally extending slot and the at least one radially extending slot, each clamping body further including:

a) a first jaw disposed in the longitudinally extending slot and having a bottom face and a contact face; and b) a second jaw disposed in the radially extending slot of the collar, the second jaw having a predetermined angle of inclination, a contact face and a back face, wherein the clamping body has a curved outer surface disposed between the bottom face of the first jaw and the back face of the second jaw, and the clamping body is movable longitudinally and radially by impingement of the end face of the hollow object on the contact face of the second jaw, the first jaw being rotatable to move beyond the peripheral contact surface of the sleeve-shaped portion of the center body such that the contact surface of the first jaw contacts the inner circumference of the hollow object by the run-on action of the end face of the hollow object with the second jaw.

2. A clamping arrangement of claim 1, wherein the first end of the center body has a compound taper.

3. The clamping arrangement of claim 2, wherein the compound taper comprises a primary taper and a secondary taper between the primary taper and the sleeve-shaped portion of the center body for alignment of the clamping arrangement with the hollow object.

4. The clamping arrangement of claim 1, wherein the first jaw has a longitudinally extending toothing on the contact surface of the first jaw.

5. The clamping arrangement of claim 1, wherein the second jaw has a radially extending toothing on the contact face.

6. The clamping arrangement of claim 4, wherein the second jaw has a radially extending toothing on the contact face.

7. The clamping arrangement of claim 6, wherein the toothing has a radius of curvature and has a spacing greater than the distance between two adjacent centers of curvatures.

8. The clamping arrangement of claim 1, further comprising an expandable containment ring, wherein the first jaw of each of the at least one clamping body is adapted to receive the expandable containment ring and the center body is adapted to receive the expandable containment ring, such that rotation and radial movement of the at least one clamping body resulting from the run-on action of the end face of the hollow object extends the containment ring and upon removal of the hollow object the containment ring restores the at least one clamping body to an initial position.

9. The clamping arrangement of claim 8, wherein a center of curvature of the combined longitudinal, radial and rotational movement of the clamping body during clamping of the hollow object is located at the center of curvature of the curved outer surface disposed between the bottom face of the first jaw and the back face of the second jaw of the clamping body.

10. The clamping arrangement of claim 8, wherein the first jaw has a longitudinally extending toothing on the contact surface of the first jaw.

11. The clamping arrangement of claim 8, wherein the second jaw has a radially extending toothing on the contact face.

12. The clamping arrangement of claim 10, wherein the second jaw has a radially extending toothing on the contact face.

13. The clamping arrangement of claim 12, wherein the taper comprises a primary taper and a secondary taper between the primary taper and the sleeve-shaped portion of the center body for alignment of the clamping arrangement with the hollow object.

14. The clamping arrangement of claim 12, wherein the toothing has a radius of curvature and has a spacing greater than the distance between two adjacent centers of curvatures.

* * * * *